United States Patent [19]

Ikeura

[11] 4,114,372

[45] Sep. 19, 1978

[54] INTERNAL COMBUSTION ENGINE WITH AIR-FUEL RATIO CONTROL DEVICE

[75] Inventor: Kenji Ikeura, Yokosuka, Japan

[73] Assignee: Nissan Motor Company, Limited, Japan

[21] Appl. No.: 694,970

[22] Filed: Jun. 11, 1976

[30] Foreign Application Priority Data

Jun. 13, 1975 [JP] Japan ..... 50-81026[U]

[51] Int. Cl.[2] ..... F02B 75/10; F02D 35/00

[52] U.S. Cl. ..... 60/276; 60/285; 123/119 EC; 261/121 B

[58] Field of Search ..... 60/276, 285; 123/119 EC, 119 R; 261/121 B

[56] References Cited

U.S. PATENT DOCUMENTS

| | | | |
|---|---|---|---|
| 3,861,366 | 1/1975 | Masaki | 123/119 EC |
| 3,906,910 | 9/1975 | Szlaga | 123/119 EC |
| 3,942,493 | 3/1976 | Linder | 123/119 EC |
| 3,963,009 | 6/1976 | Mennesson | 123/119 EC |

*Primary Examiner*—Douglas Hart

*Attorney, Agent, or Firm*—Robert E. Burns; Emmanuel J. Lobato; Bruce L. Adams

[57] ABSTRACT

The air-fuel ratio of the air-fuel mixture supplied to the combustion chambers of an internal combustion engine is regulated at a required value by controlling the air amount inducted through an additional air passage into the main well which communicates with the main discharge nozzle of a carburetor. The air amount control is accomplished by valve means which is arranged to open and close in on-and-off manner the additional air passage. An air induction passage is further formed to communicate the additional air passage downstream of the valve means with the atmosphere to introduce further air when the valve means closes the additional air passage and vacuum still remains therewithin.

6 Claims, 2 Drawing Figures

INTERNAL COMBUSTION ENGINE WITH AIR-FUEL RATIO CONTROL DEVICE

BACKGROUND OF THE INVENTION

This invention relates to an internal combustion engine in which the air-to-fuel ratio of the air-fuel mixture supplied into the combustion chambers of the engine is controlled utilizing feedback techniques in accordance with the composition of the exhaust gases discharged from the combustion chambers of the engine.

As is well known, it is now required from standpoints of exhaust gas control and fuel economy to accurately control the air-to-fuel ratio of the air-fuel mixture supplied into the combustion chambers of an internal combustion engine at a required value. Especially when the exhaust system of the internal combustion engine is equipped with a three-way catalytic converter capable of reducing nitrogen oxides as well as oxidizing hydrocarbons and carbon monoxide, the three-way catalytic converter requires to be supplied with an exhaust gases produced by combustion of the air-fuel mixture having approximately stoichiometric air-to-fuel ratio in the combustion chambers in order to allow the converter to function effectively and sufficiently. However, usual carburetors can not control so accurately the air-to-fuel ratio of the mixture supplied therefrom due to their constructions and characteristics.

In order to satisfy the above requirements, it has been proposed that the air-to-fuel ratio of the mixture supplied into the combustion chambers is controlled at the stoichiometric air-to-fuel ratio utilizing feedback techniques wherein the fuel amount supplied into the combustion chambers is directly or indirectly regulated in response to the composition of the exhaust gases which composition are detected by an exhaust gas sensor located in an exhaust passage communicated downstream of the combustion chambers of the engine. This method has been realized depending on the fact that the composition of the exhaust gases are in close relationship with the air-to-fuel ratio of the mixture supplied into the combustion chambers of the engine. In a system for performing the above method, the regulation of the fuel amount supplied to the combustion chambers is accomplished by controlling the air amount inducted through an additional air passage which communicates a main well of the carburetor with the atmosphere. The additional air passage is formed in addition to a main air bleed which is arranged to induct atmospheric air into the main well. The control of the air amount inducted through the additional air passage is carried out by valve means which is arranged to close or open in on-and-off manner the additional air passage, and to increase or decrease the air amount inducted therethrough than a predetermined amount by decreasing or increasing the time rate for closing the additional air passage than a predetermined rate.

However, this system employing such type of the inducted air amount control mechanism has encountered the following difficulty: when the throttle valve of the carburetor is opened, the additional air passage is supplied with a strong vacuum which is applied through a main discharge nozzle and the main well. However, when the engine is decelerated and the throttle valve is abruptly almost closed, the main discharge nozzle is subjected to a weak vacuum near the atmospheric pressure, but the strong vacuum is still remains in the additional air passage when the passage is closed by the valve means and accordingly the fuel in the main well is sucked and stayed in the additional air passage. The sucked and stayed fuel is thereafter discharged through the main discharge nozzle when the passage is opened and therefore invites disturbance of the control of the fuel amount discharged through the main discharge nozzle. This fuel control disturbance results in so-called car knock or undesirable frequent change of the vehicle speed.

SUMMARY OF THE INVENTION

It is, therefore, a principal object of the present invention to provide an improved internal combustion engine capable of well controlling the air-fuel ratio of the air-fuel mixture fed into the combustion chambers of the engine at a desired value by employing feedback techniques in response to the composition of the exhaust gases of the engine, maintaining stable operation of the engine.

Another object of the present invention is to provide an internal combustion engine equipped with an improved carburetor which can accurately control the fuel amount discharged through the main discharge nozzle of the carburetor to feed the combustion chambers of the engine with the air-fuel mixture of a required air-fuel ratio in response to signals transmitted from a control circuit.

BRIEF DESCRIPTION OF THE DRAWINGS

Other objects, features and advantages of the present invention will become more apparent upon reference to the succeeding description thereof, and to the drawing illustrating the preferred embodiments thereof, in which.

DESCRIPTION OF THE PREFERRED EMBODIMENTS

Figure 1:
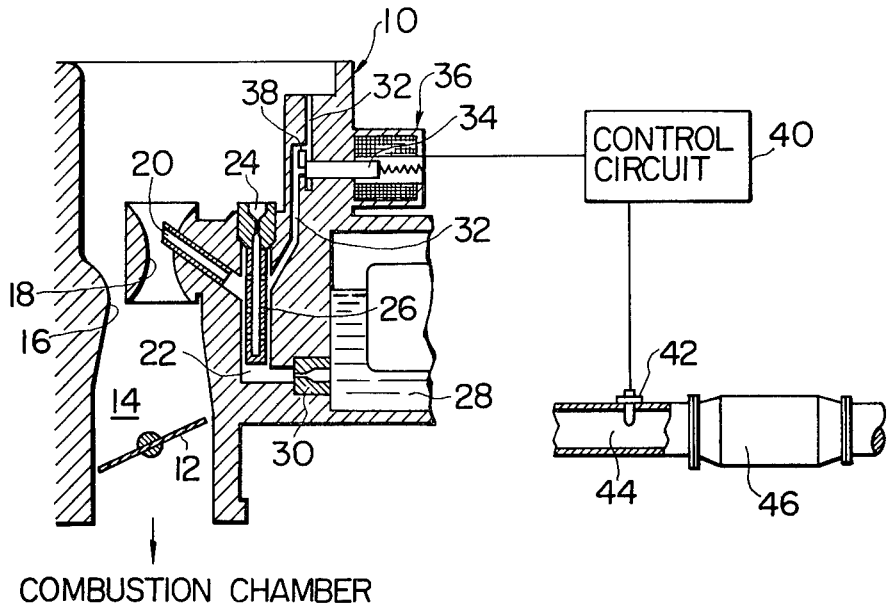
FIG. 1 is a schematical section view showing a part of a preferred embodiment of an internal combustion engine in accordance with the present invention.

Referring now to FIG. 1 there is shown a preferred embodiment of a part of an internal combustion engine in accordance with the present invention in which a carburetor 10 has a throttle valve 12 rotatably disposed, as usual, within the air-fuel mixture induction passage 14. The induction passage 14 is, as usual, communicable with the combustion chambers of the internal combustion engine (not shown). Each combustion chamber is defined by a cylinder head and a piston crown (they are not shown). A main venturi portion 16 and a secondary venturi portion 18 are located upstream of the throttle valve 12. Opened to the secondary venturi portion 18 is a main discharge nozzle 20 which is communicates with a main well 22 connected at its top portion to a main air bleed orifice 24 for communicating the main well 22 with the atmosphere. An emulsion tube 26 connected to the main air bleed orifice 24 is disposed within the main well 22 to well mix the fuel in the main well 22 with air from the main air bleed orifice 24. The main well 22 is, as customary, communicated with the float bowl 28 through a main jet 30. An additional air passage 32 or additional air passage means formed in the body casting portion of the carburetor 10 is arranged to communicate the main well 22 with the atmosphere to introduce additional air into the main well 22 in addition to the air from the main air bleed orifice 24.

A valve member 34 of an electromagnetic valve 36 or valve means is disposed at a first portion of the additional air passage 32 to be projected for closing the first portion and to be withdrawn for opening the first portion. The electromagnetic valve 36 is arranged to take first and second states. In the first state, the valve member 34 is operated and moved to increase the flow amount of air inducted through the additional air passage 32 than a predetermined amount in order to decrease the fuel amount discharged from the main discharge nozzle 20 and to make leaner the air-fuel ratio of the air-fuel mixture fed into the combustion chambers toward a predetermined level. In the second state, the valve member 34 is, on the contrary, operated and moved to decrease the flow amount of the air than the predetermined amount in order to increase the fuel amount discharged from the main discharged nozzle 20 and to make richer the air-fuel ratio of the air-fuel mixture fed into the combustion chambers toward the predetermined level. These operation manners of the valve member 34 of the electromagnetic valve 36 is, in this instance, accomplished by decreasing the rate of time for closing the first portion of the additional air passage 32 than a predetermined rate in the first state, and increasing the rate of time for closing the first portion than the predetermined rate in the second state. It will be understood that the electromagnetic valve may be replaced with other valves such as a diaphragm operated valve.

As clearly shown in FIG. 1, an air induction passage 38 or an air induction passage means is formed in the body casting portion of the carburetor 10 to connect portions of the additional air passage 32 upstream and downstream of the first portion where the valve member 34 is disposed so that the portion downstream of the first portion always communicates with the atmosphere therethrough even when the valve member 34 completely closes the first portion of the additional air passage 32. It is preferable to form the diameter of the opening of the air induction passage 38 as small as possible since the passage 38 is formed merely for the purpose of establishing the communication between the portion of the passage 32 downstream of the first portion and the atmosphere. However, the diameter is more preferably about 0.4 mm or more in order to prevent clogging of the opening of the passage 38 with dusts.

The electromagnet of the electromagnetic valve 36 is electrically connected to a control circuit 40. The control circuit 40 is arranged to generate a first command signal for placing the valve 36 into the first state and a second command signal for placing the valve 36 into the second state. The control circuit 40 is, in turn, electrically connected to an exhaust gas sensor 42 which is disposed within the exhaust passage 44 of the exhaust system of the engine upstream of an exhaust gas purifying device 46. The exhaust gas sensor 42 is arranged to generate a first information signal (which may be a voltage signal) for causing the control circuit 40 to generate the first command signal when the exhaust gases passing through the exhaust passage 44 have a first composition representing that the combustion chambers are fed with an air-fuel mixture of an air-fuel ratio richer than a predetermined level, and a second information signal for causing the control circuit 40 to generate the second command signal when the exhaust gases passing through the exhaust passage 44 have a second composition representing that the combustion chambers are fed with an air-fuel mixture of an air-fuel ratio leaner than the predetermined level.

The exhaust gas sensor 42 may be an oxygen ($O_2$) sensor, a nitrogen oxides (NOx) sensor, a carbon monoxide (CO) sensor, a carbon dioxides ($CO_2$) sensor or a hydrocarbon (HC) sensor which are respectively detect the concentration of $O_2$, NOx, CO, $CO_2$ or HC contained in the exhaust gases discharged from the combustion chambers. When the exhaust purifying device is a so-called three-way catalytic converter capable of reducing NOx as well as oxidizing CO and HC in the exhaust gases, the predetermined level of the air-fuel ratio of the air-fuel mixture supplied into the combustion chambers is stoichiometric one (14.8:1) which is required for effectively functioning the three-way catalytic converter. In case of using as the exhaust gas purifying device an oxidation catalytic converter or a reactor, the predetermined level will be selected to effectively functioning it.

In order to operate the electromagnetic valve 36 in the above discussed manner, the control circuit 40 of this case is arranged to set, as a reference voltage, a specified voltage signal generated by the exhaust gas sensor 42 when the predetermined level of the air-fuel mixture is supplied into the combustion chambers, and to generate the first command signal when the level of the voltage signal from the sensor 42 is lower than that of the specified voltage signal representing the combustion chambers are fed with the air-fuel mixture of the air-fuel ratio leaner than the predetermined level and the second command signal when the level of the voltage signal from the sensor 42 is higher than that of the specified voltage signal representing that the combustion chambers are fed with the air-fuel mixture of the air-fuel ratio richer than the predetermined level.

With the arrangement hereinbefore discussed, when the combustion chambers of the engine 10 are fed with the air-fuel mixture of the air-fuel ratio richer than the predetermined level such as stoichiometric air-fuel ratio, the valve member 34 of the electromagnetic valve 36 is operated to increase the flow amounts of air inducted through the additional air passage 32 into the main well 22. Then, the flow amount of fuel through the main discharge nozzle 20 is decreased and accordingly the air-fuel ratio of the air-fuel mixture fed into the combustion chambers is made leaner. On the contrary, when the combustion chambers are fed with the air-fuel mixture of the air-fuel ratio leaner than the predetermined level, the valve member 34 is operated to decrease the flow amount of air inducted through the additional air passage 32 into the main well 22. Then, the flow amount of fuel through the main discharge nozzle 20 is increased and accordingly the air-fuel mixture fed into the combustion chambers are enriched. As discussed above, the air-fuel ratio of the air-fuel mixture supplied into the combustion chambers can be always controlled at the predetermined level.

When the vacuum generated at the secondary venturi portion 18 of the carburetor 10 or the vacuum adjacent the main discharge nozzle 20 is abruptly decreased toward the atmospheric pressure due to closing of the throttle valve 12 occurred during deceleration of the engine, and additionally the valve member 34 of the electromagnetic valve 36 completely closes the first portion of the additional air passage 32, a small amount of atmospheric air is inducted through the air induction passage 38 into the additional air passage downstream of the first portion where the valve member 34 is disposed to decrease the vacuum within the additional air passage 32 for changing the vacuum into the atmospheric pressure. Accordingly, by virtue of the air induction passage 38, the fuel from the main well 22 is not forced to flow back into and does not stay within the additional air passage 32.

In this connection, if the air induction passage 38 according to the present invention is not formed in the carburetor 10, the fuel within the main well 22 is forced to flow back into the additional air passage 32 and stays therein when the vacuum at the secondary venturi portion 18 is abruptly decreased toward the atmospheric pressure and the valve member 34 of the electromagnetic valve 36 completely closes the first portion of the additional air passage 32. At this time, the fuel discharge through the main discharge nozzle 20 is momentarily stopped. When the valve member 34, thereafter, opens the first portion of the additional air passage 32 at the same condition, the fuel stayed within the additional air passage 32 is abruptly sucked into the main well 22 and accordingly the amount of fuel discharged through the main discharge nozzle 20 is momentarily increased. This disturbance of the fuel amount discharged through the main discharge nozzle 20 results in engine surge or changes in engine speed which contributes to so-called car knock or undesirable frequent change of vehicle speed.

Figure 2:
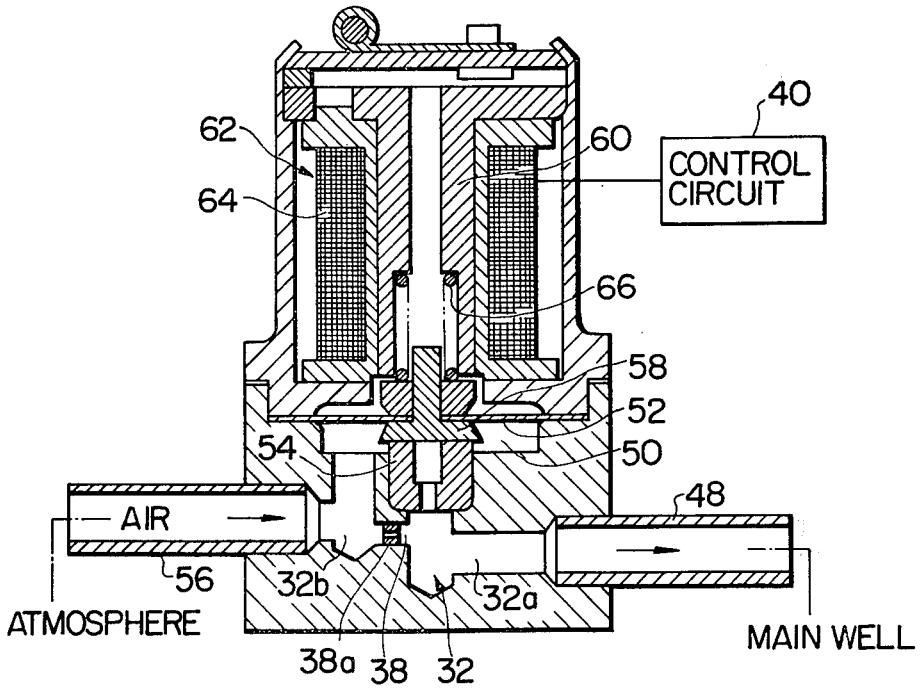
FIG. 2 is a section view of a part of a carburetor which is used in another preferred embodiment of the engine in accordance with the present invention.

FIG. 2 illustrates a part of the carburetor of the engine of another preferred embodiment in accordance with the present invention, in which the other part of the engine is omitted for the purpose of simplicity of illustration since the other part is same as the embodiment of FIG. 1. As shown, a first portion 32*a* of the additional air passage 32 or a first additional air passage is formed in the body casting portion of the carburetor 10 to be communicated at its one end with the main well 22 through a pipe 48 and at its other end with an atmospheric chamber 50 defined by a diaphragm 52 through a valve seat 54. The valve seat 54 is, as seen, disposed at a portion where the first additional air passage 32*a* opens to the atmospheric chamber 50, and having an opening formed through the valve seat 54, the opening being communicated with the first additional air passage 32*a*. A second portion 32*b* of the additional air passage 38 or a second additional air passage is communicated at its one end with the atmospheric chamber 50 and at the other end with the atmosphere through a pipe 56. Movably disposed on the valve seat 54 is a valve member 58 which is secured to the central portion of the diaphragm 52. The valve member 58 has a portion made of a magnetic material or a material which is magnetically affected, and arranged to be attracted by a core 60 of an electromagnet 62 such that the valve member 58 detaches from the valve seat 54 to establish communication between the first and second additional air passages 32*a* and 32*b* when electric current is applied to a solenoid coil 64 surrounding the core 60 to energize the core 60, or be urged to contact with the valve seat 54 by the action of a spring 66 for blocking communication between the first and second additional air passages 32*a* and 32*b* when the electric current is not applied to the solenoid coil 64 to de-energize the core 60. As seen, the spring 66 is disposed within a groove formed at the inner surface of the core 60 of a cylindrical form. The air induction passage 38 is formed to connect the first and second additional air passages 32*a* and 32*b*. Disposed within the air induction passage 38 is an orifice 38*a* whose opening has a diameter of about 0.4 mm or more. The electromagnet 62 is arranged to take a first state wherein the energizing time rate of the core 60 thereof is increased than a predetermined rate to make leaner the air-fuel ratio of the air-fuel mixture fed into the combustion chambers of the engine, and a second state wherein the energizing time rate of the core 60 thereof is decreased than the predetermined rate to make richer the air-fuel ratio of the air-fuel mixture fed into the combustion chambers of the engine. In this case, the control circuit is arranged to generate the first command signal to place the electromagnet 62 in the first state when receiving the first information signal form the exhaust gas sensor 42, and the second command signal to place the electromagnet 62 in the second state when receiving the second information signal from the exhaust gas sensor 42.

It will be seen that the valve mechanism of the embodiment of FIG. 2 improves response characteristics and durability of the valve member 58 since the valve mechanism does not employ a member along which the valve member 58 is slidably moved.

While only the air induction passage 38 applied to the main circuit of the carburetor 10 is shown and described through the embodiments of FIGS. 1 and 2, it will be understood that the air induction passage 38 may be applied to the low-speed circuit of the carburetor.

As is apparent form the foregoing discussion, according to the present invention, the undesirable disturbance of control of the air-fuel ratio of the air-fuel mixture fed into the combustion chambers is effectively prevented even during deceleration of the engine and therefore stable operation of the engine is always maintained.

What is claimed is:

1. An internal combustion engine having a cylinder in which a combustion chamber is defined by a cylinder head and a piston crown, comprising:

a carburetor including a throttle valve, a venturi portion upstream of the throttle valve, a main discharge nozzle opening to the venturi portion, a float bowl, a main jet, a main well communicating with the main discharge nozzle opening to the venturi portion disposed upstream of the throttle valve of said carburetor, the main well being communicating through the main jet with the float bowl of said carburetor, means defining a main air bleed orifice connected to said main well for communicating between the atmosphere and said main well, means defining a first additional air passage connected to said main well, a diaphragm defining an atmospheric chamber into which said first additional air passage opens, means defining a second additional air passage communicating between said atmospheric chamber and the atmosphere, means defining an air induction passage connecting a portion of said first additional air passage and a portion of said second additional air passage, means defining an orifice disposed within said air induction passage, a valve seat disposed at a portion where said first additional air passage opens to said atmospheric chamber, a valve member secured to said diaphragm to open and close the opening formed through said valve seat, the opening communicating with said first additional air passage, said valve member having a portion which is magnetically affected, an electromagnet disposed opposite of said valve seat with respect to said diaphragm and having a core which attracts said valve member in the direction to detach from said valve seat to establish communication between said first and second additional air passages when said electromagnet is energized, and a spring member disposed to urge said valve member in the direction to contact with said valve seat for blocking the communication between said first and second additional air passages when said electromagnet is deenergized; and control means to place said electromagnet into a first state wherein the energizing time rate of said electromagnet is increased to a rate greater than a predetermined rate to make leaner the air-fuel ratio of the air-fuel mixture fed into the combustion chamber toward a predetermined level when the exhaust gases of the engine have a first composition representing that the combustion chamber is fed with an air-fuel mixture of the air-fuel ratio richer than the predetermined level, and into a second state wherein the energizing time rate is decreased to a rate less than the predetermined rate to make richer the air-fuel ratio of the air-fuel mixture fed into the combustion chamber toward the predetermined level when the exhaust gases of the engine have a second composition representing that the combustion chamber is fed with the air-fuel mixture of the air-fuel ratio lean than the predetermined level.

2. An internal combustion engine as claimed in claim 1, in which said control means includes:

a control circuit electrically connected to said electromagnet to generate a first command signal to place said electromagnet into the first state and a second command signal to place said electromagnet into the second state; and an exhaust gas sensor disposed within the exhaust gas passage of the exhaust system of the engine which passage communicates with the cylinder downstream of the combustion chamber, said exhaust gas sensor being electrically connected to said control circuit to generate a first information signal for causing said control circuit to generate the first command signal when the exhaust gases passing through the exhaust passage have the first composition, and a second information signal for causing said control circuit to generate the second command signal when the exhaust gases passing through the exhaust passage have the second composition.

3. An internal combustion engine as claimed in claim 1, further comprising an exhaust gas purifying device communicable through the exhaust passage with the combustion chamber.

4. An internal combustion engine as claimed in claim 3, in which said exhaust gas purifying device is a three-way catalytic converter capable of reducing nitrogen oxides as well as oxidizing carbon monoxide and hydrocarbons, said three-way catalytic converter being located downstream of said exhaust gas sensor.

5. An internal combustion engine as claimed in claim 4, in which said predetermined level of the air-fuel mixture is stoichiometric air-to-fuel ratio.

6. An internal combustion engine as claimed in claim 5, in which said exhaust gas sensor is an oxygen sensor for detecting the concentration of oxygen contained in the exhaust gases discharged from the combustion chamber of the engine.

* * * * *